US006343780B1

(12) United States Patent
Nakazato

(10) Patent No.: US 6,343,780 B1
(45) Date of Patent: Feb. 5, 2002

(54) ACCELERATION APPARATUS OF CARBURETOR

(75) Inventor: Kenji Nakazato, Fujisawa (JP)

(73) Assignee: Keihin Corporation, Tokyo (JP)

( * ) Notice: Subject to any disclaimer, the term of this patent is extended or adjusted under 35 U.S.C. 154(b) by 0 days.

(21) Appl. No.: 09/649,182

(22) Filed: Aug. 28, 2000

(30) Foreign Application Priority Data

Oct. 1, 1999 (JP) ..... 11-280906

(51) Int. Cl.[7] ..... F02M 7/08
(52) U.S. Cl. ..... 261/34.2
(58) Field of Search ..... 261/34.2, 34.1, 261/34.3, 35, 69.1, 69.2, DIG. 68

(56) References Cited

U.S. PATENT DOCUMENTS

| | | | | |
|---|---|---|---|---|
| 2,768,818 A | * | 10/1956 | Egerer | 261/34.2 X |
| 2,919,908 A | * | 1/1960 | Newman | 261/34.2 |
| 2,926,892 A | * | 3/1960 | Wentworth | 261/34.2 |
| 3,904,712 A | * | 9/1975 | Taylor | 261/34.2 |
| 4,000,223 A | * | 12/1976 | Yoshioka et al. | 261/34.2 |
| 4,064,201 A | * | 12/1977 | Sanka et al. | 261/34.2 |
| 4,089,914 A | * | 5/1978 | Yoshioka et al. | 261/34.2 |
| 4,105,720 A | * | 8/1978 | Hohsho et al. | 261/34.2 |
| 4,278,618 A | * | 7/1981 | Hagashigawa et al. | 261/34.2 |
| 4,305,368 A | * | 12/1981 | Phelan et al. | 261/34.2 X |
| 4,390,480 A | * | 6/1983 | Noisier | 261/34.3 X |
| 4,440,697 A | * | 4/1984 | Sakurai | 261/34.2 |
| 4,481,914 A | * | 11/1984 | Ishida | 261/34.2 X |

FOREIGN PATENT DOCUMENTS

| | | | | |
|---|---|---|---|---|
| JP | 60-75751 | * | 4/1985 | 261/34.2 |

* cited by examiner

*Primary Examiner*—Richard L. Chiesa
(74) *Attorney, Agent, or Firm*—R. Neil Sudol; Henry D. Coleman; William J. Sapone

(57) ABSTRACT

The invention provides an inexpensive acceleration apparatus of a carburetor which can stably supply a fuel for acceleration for a long time. In the acceleration apparatus of the carburetor, a cam lever (8) provided with a cam surface (8A) is fixed to a throttle valve operating shaft (4A) disposed between a throttle lever (5) and an end portion (3A) of a supporting boss (3). A first lever (10) is brought into contact with the cam surface (8A) of the cam lever by a first spring (12) for urging in a first rotational direction (A). A second lever (11) is brought into contact with a restriction portion (10C) of the first lever (10) by a second spring (13) for urging in a second rotational direction (B), and is arranged in such a manner as to be brought into contact with a pump rod (6H) for pressing a pump diaphragm (7) of a pump apparatus (P). A contact portion (K) of the first lever (10) brought into contact with the cam surface (8A) of the cam lever (8) is arranged between the throttle lever (5) and the end portion (3A) of the supporting boss (3) in a direction of a longitudinal axis (Y—Y) of the throttle valve operating shaft (4) and within a projected plane of the throttle lever (5) on a surface perpendicular to the longitudinal axis (Y—Y) of the throttle valve operating shaft (4).

1 Claim, 2 Drawing Sheets

ACCELERATION APPARATUS OF CARBURETOR

BACKGROUND OF THE INVENTION

1. Field of the Invention

The present invention relates to a carburetor for adjusting and controlling a concentration and an amount of a mixture supplied toward an engine, and more particularly to an acceleration apparatus of a carburetor for injecting and supplying a fuel for acceleration into an inner portion of an intake passage from an acceleration pump at a time of suddenly opening a throttle valve.

2. Description of the Prior Art

A description will be given of an acceleration apparatus of a carburetor in accordance with a conventional art. A throttle valve operating shaft is rotatably supported to a main body of the carburetor, a throttle lever is fixed and arranged to an end portion thereof, and the throttle lever is connected to an acceleration grip via an acceleration wire. Accordingly, when the acceleration grip is rotated by a driver, the throttle lever rotates in accordance therewith so as to rotate the throttle valve operating shaft, so that the throttle valve connected to the throttle valve operating shaft opens and closes the intake passage. Further, the structure is made such that a cam lever having a cam surface is fixed and arranged to the throttle valve operating shaft, and the cam lever is structured such as to synchronously rotate with the throttle valve operating shaft. An acceleration pump operating shaft is further supported to the main body of the carburetor, and an acceleration operating lever is fixed and arranged to the acceleration pump operating shaft. The acceleration operating lever is structured such as to synchronously rotate with the acceleration pump operating shaft, and the acceleration operating lever is provided with an engagement portion brought into contact with the cam surface of the cam lever and is engaged with an upper end of a pump rod for pressing a diaphragm of the acceleration pump. In this case, when the acceleration grip is rotated and the throttle valve operating shaft rapidly rotates in an opening direction of the throttle valve, the cam surface of the cam lever rotates the acceleration operating lever via the engagement portion, whereby the pump rod presses the pump diaphragm so as to compress a pump chamber, thereby injecting and supplying a desired fuel for acceleration into the inner portion of the intake passage.

In the conventional acceleration apparatus mentioned above, the acceleration operating lever for operating the pump rod is structured such that the engagement portion of the acceleration operating lever is brought into contact with the cam surface of the cam lever, where by a rotational force is applied. Here, paying attention to the cam surface and the engagement portion of the acceleration operating lever, the cam surface of the cam lever moves along the engagement portion of the acceleration operating lever while being brought into contact therewith. On the other hand, a contact portion between the cam surface of the cam lever and the engagement portion of the operating lever is not protected against outside by a protecting member. In accordance with the structure mentioned above, there is a risk that a fine foreign stuff is meshed with the contact portion, whereby there is a risk that the cam surface of the cam lever or the engagement portion of the operating lever corresponding to the contact portion is abraded at a long time use, so that it is hard to obtain a stable operating stroke of the pump diaphragm for a long time and it is hard to stably supply a fuel for acceleration to the engine for a long time. There is a case that the problems mentioned above are generated in a two-wheeled vehicle, an agricultural machine or the like in which the carburetor is directly exposed to outside.

SUMMARY OF THE INVENTION

The present invention is made by taking the problems into consideration, and an object of the present invention is to provide an inexpensive acceleration apparatus of a carburetor which can stably supply a fuel for acceleration for a long time.

In order to achieve the object mentioned above, in accordance with the present invention, there is provided an acceleration apparatus of a carburetor comprising:

- a throttle valve for opening and closing an intake passage extending through a main body of a carburetor;
- a throttle valve operating shaft rotatably supported to a supporting boss of the main body of the carburetor, having a throttle lever mounted at an end portion thereof, and opening and closing the throttle valve;
- a cam lever fixed to a throttle valve operating shaft disposed between the throttle lever and the end portion of the supporting boss and provided with a cam surface;
- an acceleration pump operating shaft stood from the main body of the carburetor;
- a first lever rotatably pivoted to the acceleration pump operating shaft and brought into contact with the cam surface of the cam lever by a first spring for urging in a first rotational direction; and
- a second lever rotatably pivoted to the acceleration pump operating shaft, brought into contact with a restriction portion of the first lever by a second spring for urging in a second rotational direction, and arranged in such a manner as to be brought into contact with a pump rod for pressing a pump diaphragm of a pump apparatus, wherein a contact portion of the first lever brought into contact with the cam surface of the cam lever is arranged between the throttle lever and the end portion of the supporting boss in a direction of a longitudinal axis of the throttle valve operating shaft and within a projected plane of the throttle lever on a surface perpendicular to the longitudinal axis of the throttle valve operating shaft.

Since the cam surface of the cam lever and the contact portion of the first lever are arranged between the throttle lever and the end portion of the supporting boss and within the projected plane of the throttle ever, it effectively prevents a foreign stuff from being attached to the contact portion from outside, whereby it is possible to reduce a sliding friction between the cam surface of the cam lever and the contact portion of the first lever and it is possible to stably supply a fuel for acceleration for a long time.

DESCRIPTION OF THE PREFERRED EMBODIMENT

Figure 1:
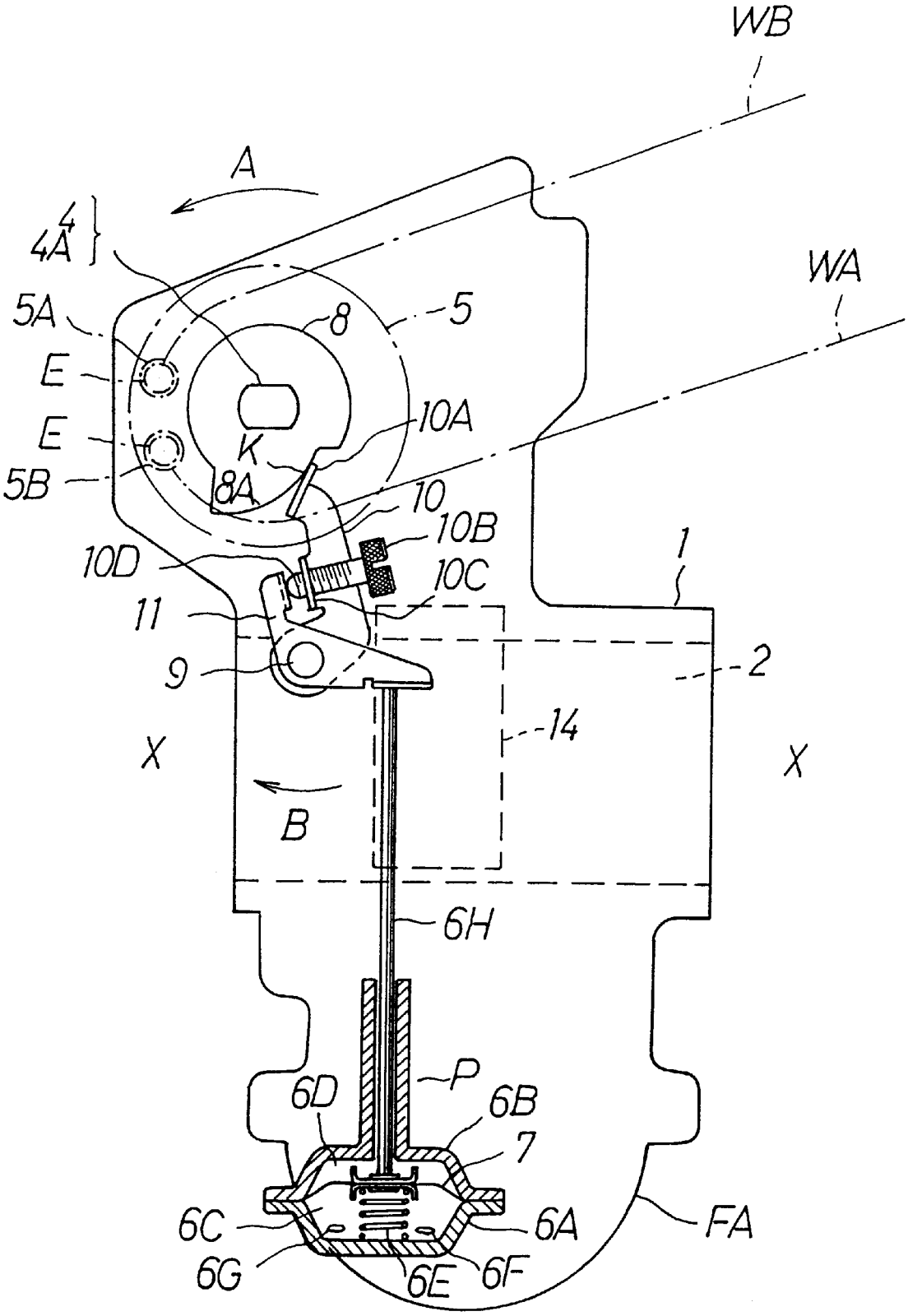
FIG. 1 is a side elevational view including a cross sectional view of a main portion which shows an embodiment of an acceleration apparatus of a carburetor in accordance with the present invention.
Figure 2:
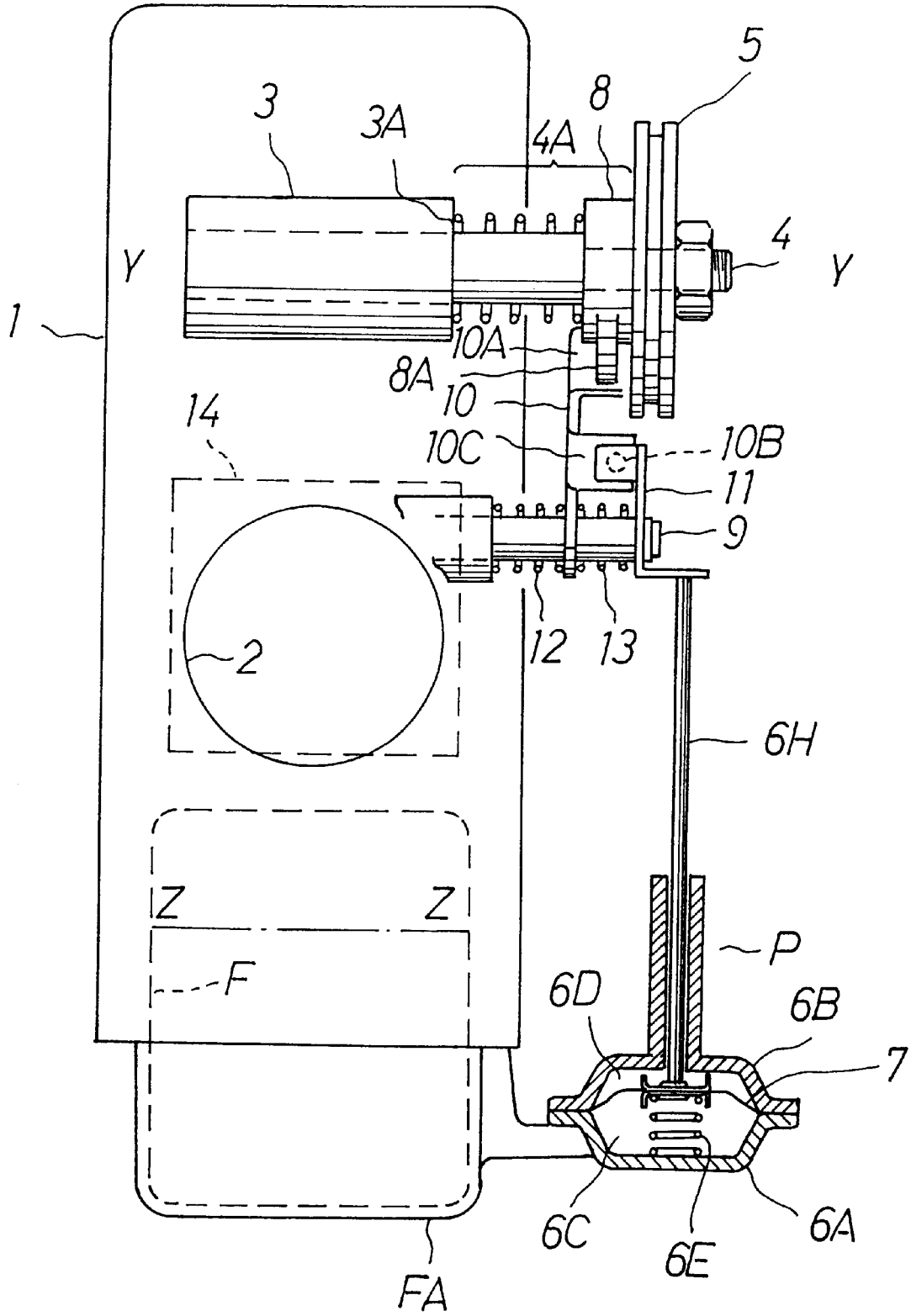
FIG. 2 is a left side elevational view including a cross sectional view of the main portion shown in FIG. 1.

A description will be given below of an embodiment of an acceleration apparatus of a carburetor in accordance with the present invention with reference to the accompanying drawings. FIG. 1 is a side elevational view including a cross sectional view of a main portion of an acceleration apparatus of a carburetor. FIG. 2 is a left side elevational view of a main portion including a cross sectional view of a part in FIG. 1. Reference numeral 1 denotes a main body of a carburetor within which an intake passage 2 passes sideward. A supporting boss 3 is formed above the carburetor main body 1 in a direction perpendicular to a longitudinal axis X—X of the intake passage 2. A throttle valve operating shaft 4 is rotatably supported to the supporting boss, and a pump apparatus P is arranged on a lower side portion of the carburetor main body 1.

The throttle valve operating shaft 4 is structured such that a left end thereof in FIG. 2 is rotatably supported to the supporting boss 3 and a throttle lever 5 is fixedly arranged on a right end of the throttle valve operating shaft 4 protruding from an end portion 3A of the supporting boss 3 toward a right portion. In this case, end holes 5A and 5B for mounting wire ends E provided in end portions of a valve opening wire WA and a valve closing wire WB are pierced on the throttle lever 5.

Further, the pump apparatus P is structured as follows. A pump diaphragm 7 is held between a pump body 6A and a pump cover 6B, whereby a pump chamber 6C is formed in a side of the pump body 6A and an atmospheric chamber 6D is formed in a side of the pump cover 6B. A pump spring 6E for pressing the pump diaphragm 7 to the side of the atmospheric chamber 6D is compressed within the pump chamber 6C, and an intake passage 6F provided with an intake side check valve (not shown) and a discharge passage 6G provided with a discharge side check valve are opened within the pump chamber 6C. The intake passage is communicated with a lower portion under a constant fuel liquid surface Z—Z of a float chamber F in the carburetor, and the discharge passage 6G is communicated with the intake passage 2 so as to be open. Further, reference numeral 6H denotes a pump rod movably guided and arranged within a guide hole of the pump cover 6B. The pump rod 6H passes through an inner portion of the atmospheric chamber 6D and is arranged in such a manner as to be brought into contact with the pump diaphragm 7. In this case, the pump body 6A in the present embodiment is integrally formed with a float chamber main body FA forming the float chamber F.

Reference numeral 8 denotes a cam lever. The cam lever 8 is structured as follows. The cam lever 8 is arranged in such a manner as to be fixed to the throttle valve operating shaft 4A disposed between the end portion 3A of the supporting boss 3 and the throttle lever 5, and is provided with a cam surface 8A. The cam lever 8 including the cam surface 8A is arranged within a projected plane of the throttle lever 5 on a surface perpendicular to the longitudinal axis Y—Y of the throttle valve operating shaft 4. In other words, in the case of viewing from a right side in FIG. 2, the cam lever 8 is arranged within a flat surface projected plane of the throttle lever 5, and is well shown in FIG. 1. In FIG. 1, the throttle lever 5 is illustrated by an imaginary line.

Reference numeral 9 denotes an acceleration pump operating shaft stood from the carburetor main body 1, and a first lever 10 and a second lever 11 are rotatably supported to the acceleration pump operating shaft. The first lever 10 is provided with an engagement portion 10A brought into contact with the cam surface 8A of the cam lever 8 and a restricting portion 10C meshed with an adjusting screw 10B.

The second lever 11 faces to and is brought into contact with a front end of the adjusting screw 10B and a rear end of the pump rod 6H, respectively.

Reference numeral 12 denotes a first spring. The first spring 12 is structured such that one end is engaged with the carburetor main body 1 and another end is engaged with the first lever 10. The first lever 10 is urged in a first rotational direction A (in a counterclockwise direction in FIG. 1) by the first spring 12, whereby the engagement portion 10A is urged in such a manner as to be brought into contact with the cam surface 8A of the cam lever 8.

Reference numeral 13 denotes a second spring. The second spring 13 is structured such that one end is engaged with the second lever 11 and another end is engaged with the first lever 10 or the carburetor main body 1. The second lever 11 is urged in a second rotational direction B (in a clockwise direction in FIG. 1) by the second spring 13, whereby the second lever 11 is urged to the front end 10D of the adjusting screw 10B and is brought into contact with a rear end of the pump rod 6H. In this case, the first spring 12 and the second spring 13 are not shown in FIG. 1. Further, reference numeral 14 denotes a throttle valve for opening and closing the intake passage 2. The throttle valve is mechanically connected to the throttle valve operating shaft 4 by a link (not shown) or the like. In the present embodiment, when the throttle valve operating shaft 4 rotates in the first rotational direction A (the counterclockwise direction), the throttle valve 14 opens the intake passage 2.

In accordance with the acceleration apparatus of the carburetor having the structure mentioned above, in a low opening degree state of the throttle valve 14 as illustrated, when the throttle lever 5 is rotated in the first rotational direction A (the counterclockwise direction) by a driver and the throttle valve 14 suddenly opens the intake passage 2 via the throttle valve operating shaft 4, the cam lever 8 also synchronously rotates in the first rotational direction A. Accordingly, the first lever 10 rotates in the second rotational direction B (the clockwise direction) against the spring force of the first spring 12 by the cam surface 8A of the cam lever 8. In accordance with the rotation of the first lever 10 in the second rotational direction B, the second lever 11 synchronously rotates in the second rotational direction B in such a manner as to follow the rotation of the first lever 10 due to the spring force of the second spring 13 in a state of being brought into contact with the front end 10D of the adjusting screw 10B. Then, in accordance with the rotation of the second lever 11 in the second rotational direction B, the second lever 11 presses the pump rod 6H in a downward direction in the drawing and displaces the pump diaphragm 7 of the pump apparatus P to the side of the pump chamber 6C against the spring force of the pump spring 6E so as to compress the pump chamber 6C. In accordance with the structure mentioned above, the fuel stored within the pump chamber 6C is pressurized and discharged into the intake passage 2 from the discharge passage 6G, whereby the acceleration fuel is injected into the intake passage 2 and the accelerating operation of the engine is well performed.

The operation of the acceleration pump mentioned above is the same as the conventional one, however, in accordance with the acceleration apparatus of the present invention, a contact portion K between the cam surface 8A of the cam lever 8 and the engagement portion 10A of the first lever 10 (1) is arranged between the end portion 3A of the supporting boss 3 and the throttle lever 5 and (2) is arranged within the projected plane of the throttle lever 5 on the surface perpendicular to the longitudinal axis Y—Y of the throttle valve shaft 4, whereby it is possible to stably supply a desired acceleration fuel for a long time. That is, the contact portion K between the cam surface 8A of the cam lever 8 and the engagement portion 10A of the first lever 10 exists on a back surface of the throttle lever 5 and the contact portion K is not open so as to directly face to outside, thereby preventing a peripheral dirt, a foreign stuff or the like from being directly attached to or hitting the contact portion K. This is effective particularly in a structure such as a two-wheeled vehicle in which the engine including the carburetor is directly exposed to outside. Further, although it is possible to obtain the effect mentioned above by protecting the contact portion K by a cover member or the like, it is necessary to independently prepare the cover member. Accordingly, the numbers of the parts and the assembling processes are increased, thereby increasing a cost of the product, so that this is not preferable. Further, since the throttle lever 5 is arranged in the outermost side of the carburetor main body in accordance with the structure mentioned above, at a time when the wire ends E are mounted in the end holes 5A and 5B, it is possible to maintain a good mounting performance of the wires.

As mentioned above, in accordance with the acceleration apparatus of the carburetor of the present invention, since the contact portion of the first lever brought into contact with the cam surface of the cam lever is arranged between the throttle lever and the end portion of the supporting boss in the direction of the longitudinal axis of the throttle valve operating shaft and within the projected plane of the throttle lever on the surface perpendicular to the longitudinal axis Y—Y of the throttle valve operating shaft, it is possible to widely improve an abrasion resistance of the contact portion and it is possible to stably supply the acceleration fuel for a long time. In addition, when realizing the structure, no cost increase is generated, so that it is possible to significantly easily apply the structure to the conventional acceleration apparatus.

What is claimed is:

1. An acceleration apparatus of a carburetor comprising:

a throttle valve (14) for opening and closing an intake passage (2) extending through a main body of a carburetor (1);

a throttle valve operating shaft (4) rotatably supported to a supporting boss (3) of the main body of the carburetor (1), having a throttle lever (5) mounted at an end portion thereof, and opening and closing the throttle valve (14);

a cam lever (8) fixed to a throttle valve operating shaft (4A) disposed between the throttle lever (5) and the end portion (3A) of the supporting boss (3) and provided with a cam surface (8A);

an acceleration pump operating shaft (9) stood from the main body of the carburetor (1);

a first lever (10) rotatably pivoted to the acceleration pump operating shaft (9) and brought into contact with the cam surface (8A) of the cam lever (8) by a first spring (12) for urging in a first rotational direction (A); and a second lever (11) rotatably pivoted to the acceleration pump operating shaft (9), brought into contact with a restriction portion (10C) of the first lever (10) by a second spring (13) for urging in a second rotational direction (B), and arranged in such a manner as to be brought into contact with a pump rod (6H) for pressing a pump diaphragm (7) of a pump apparatus (P), wherein a contact portion (K) of the first lever (10) brought into contact with the cam surface (8A) of said cam lever (8) is arranged between the throttle lever (5) and the end portion (3A) of the supporting boss (3) in a direction of a longitudinal axis (Y—Y) of the throttle valve operating shaft (4) and within a projected plane of the throttle lever (5) on a surface perpendicular to the longitudinal axis (Y—Y) of the throttle valve operating shaft (4).

* * * * *